US005505573A

United States Patent [19]

Han

[11] Patent Number: 5,505,573

[45] Date of Patent: Apr. 9, 1996

[54] PARKING TOWER

[76] Inventor: Tai-Kang Han, 2nd Fl., No. 18, Lane 787, Sec. 2, Kuo Kwang Rd., Ta Li Hsiang, Taichung Hsien, Taiwan

[21] Appl. No.: 365,692

[22] Filed: Dec. 29, 1994

[51] Int. Cl.[6] ..... B65G 1/10

[52] U.S. Cl. ..... 414/254; 414/257; 414/264

[58] Field of Search ..... 414/790, 254, 414/253, 255, 256, 259, 260, 261, 264, 252, 245, 246, 227, 241, 282; 364/478

[56] References Cited

U.S. PATENT DOCUMENTS

| | | | |
|---|---|---|---|
| 2,647,647 | 8/1953 | Alimanestiano | 414/254 |
| 2,838,186 | 6/1958 | Alimanestiano | 414/254 |
| 2,923,421 | 2/1960 | de Roumefort | 414/254 X |
| 3,675,799 | 7/1972 | Steed | 414/264 X |
| 5,374,150 | 12/1994 | Becker et al. | 414/254 |

FOREIGN PATENT DOCUMENTS

| | | | |
|---|---|---|---|
| 108769 | 4/1990 | Japan | 414/257 |
| 119270 | 5/1991 | Japan | 414/254 |

*Primary Examiner*—Frank E. Werner
*Attorney, Agent, or Firm*—Schmeiser, Olsen & Watts

[57] ABSTRACT

A parking tower includes a plurality of layers, an elevator device mounted in a frame structure and movable up and down to each of the plurality of layers by means of a lifting device, at least one conveying device slidably mounted on each of the plurality of layers and movable horizontally in a parking zone of associated layer for supporting a car thereon, at least one pair of pinions mounted in each of the plurality of layers and each meshing with a corresponding rack of the conveying device, at least one pair of transmission devices mounted on each of the layers and each actuated by a driving device for rotating a corresponding one of the pinions, at least one pair of manipulating devices each detachably connecting between a corresponding one of the transmission devices and associated pinion.

3 Claims, 8 Drawing Sheets

PARKING TOWER

BACKGROUND OF THE INVENTION

1. Field of the Invention

The present invention relates to a parking tower.

2. Related Prior Art

A conventional mechanical parking tower requires a large number of actuating motors to be installed therein and has a complex structure and construction, requiring a plurality of operational procedures when parking, thereby requiring a high cost in fitting and causing time-consuming operations. In addition, the conventional parking tower easily creates a great noise, so incurring an uncomfortable sensation to a user during operation.

The present invention has arisen to mitigate and/or obviate the above-mentioned disadvantages of the conventional parking tower.

SUMMARY OF THE INVENTION

The primary objective of the present invention is to provide a parking tower which is operated to park a car in a comb-like manner.

In accordance with one aspect of the present invention, there is provided a parking tower comprising a frame structure which is mounted on the ground and includes a plurality of layers each having at least one parking zone provided therein for parking a car, a lifting device mounted on top of the frame structure, an elevator device mounted in the frame structure and movable up and down to each of the plurality of layers by means of the lifting device, at least one conveying device slidably mounted on each of the plurality of layers and movable horizontally in the parking zone of associated the layer for supporting the car thereon, a pair of parallel racks longitudinally formed on an underside of each of the conveying devices, at least one pair of pinions mounted in each of the plurality of layers and each meshing with a corresponding one of the racks, at least one driving device mounted in the frame structure, at least one pair of transmission devices mounted on each of the plurality of layers and each actuated by the driving device for rotating a corresponding one of the pinions, at least one pair of manipulating devices each detachably connecting between a corresponding one of the transmission devices and associated pinion and movable between a first position where the manipulating device is in contact with associated transmission device and associated pinion such that the pinion is operated to rotate in concert with the associated transmission device via the associated manipulating device by means of the driving device, thereby moving the associated rack therewith so as to displace the associated conveying device horizontally, and a second position where the manipulating device is released from the associated transmission device and the associated pinion such that the pinion stops rotating.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
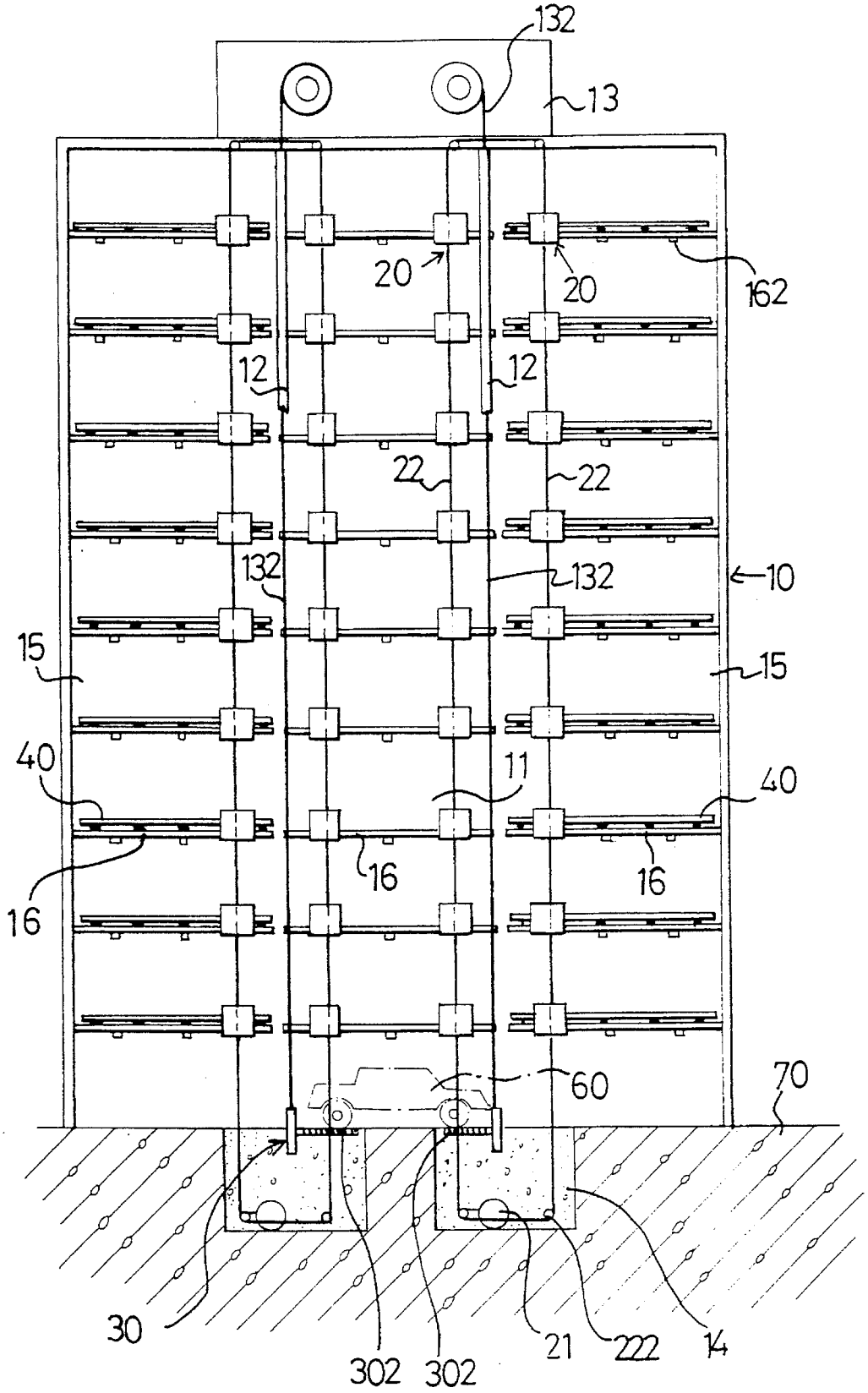
FIG. 1 is a front plan partially cross-sectional view of a parking tower in accordance with the present invention.

Referring to the drawings and initially to FIG. 1, a parking tower in accordance with the present invention comprises a frame structure 10 which is mounted on the ground 70 and includes a plurality of layers each layer having two horizontal parallel beams 102 spaced from a distance with other and each layer having a middle elevating zone 11 and two side parking zone 15 provided therein for parking a car 60, a lifting device 13 mounted on top of the frame structure 10, an elevator device 30 mounted in the middle elevating zone 11 of the frame structure 10 for elevating/lowering the car 60 and movable up and down to each of the plurality of layers by means of two pairs of elevating belts 132 which are driven by the lifting device 13, a pair of conveying devices 40 slidably received in each of the plurality of layers for supporting the car 60 thereon, each of the pair of conveying devices 40 slidably mounted on a corresponding one of the two side parking zones 15 and movable horizontally between the parking zone 15 and the middle elevating zone 11.

Figure 2:
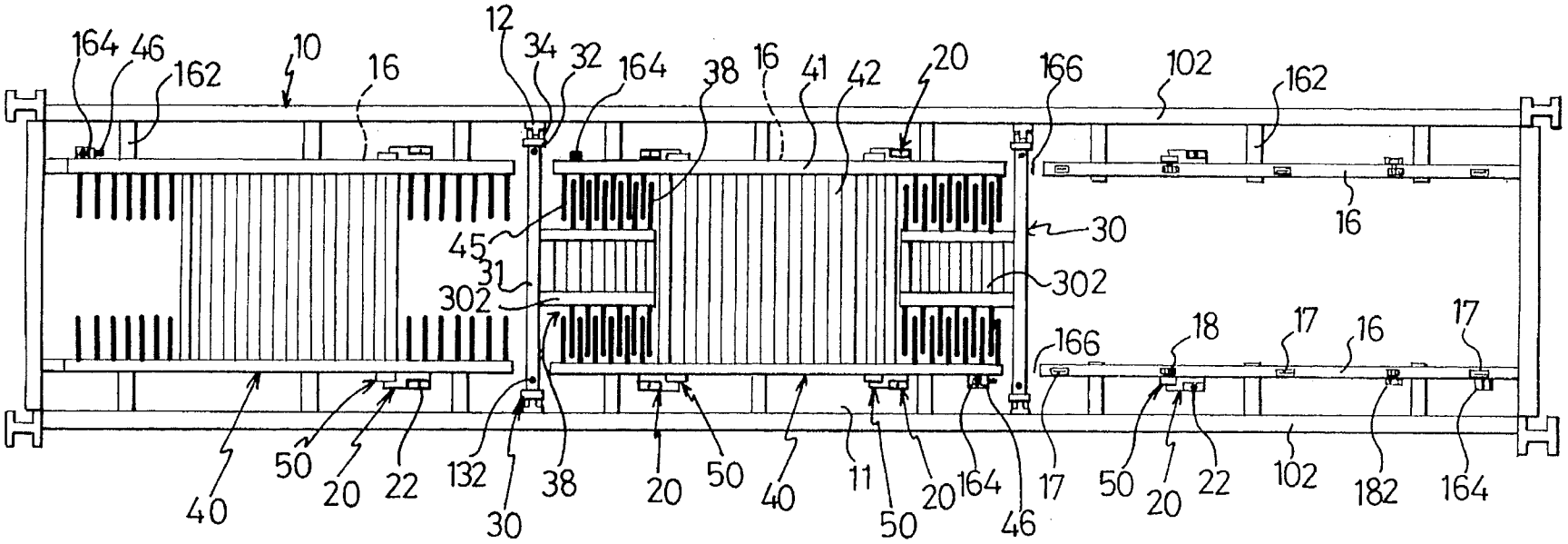
FIG. 2 is a top plan view of the parking tower as shown in FIG. 1.
Figure 3:
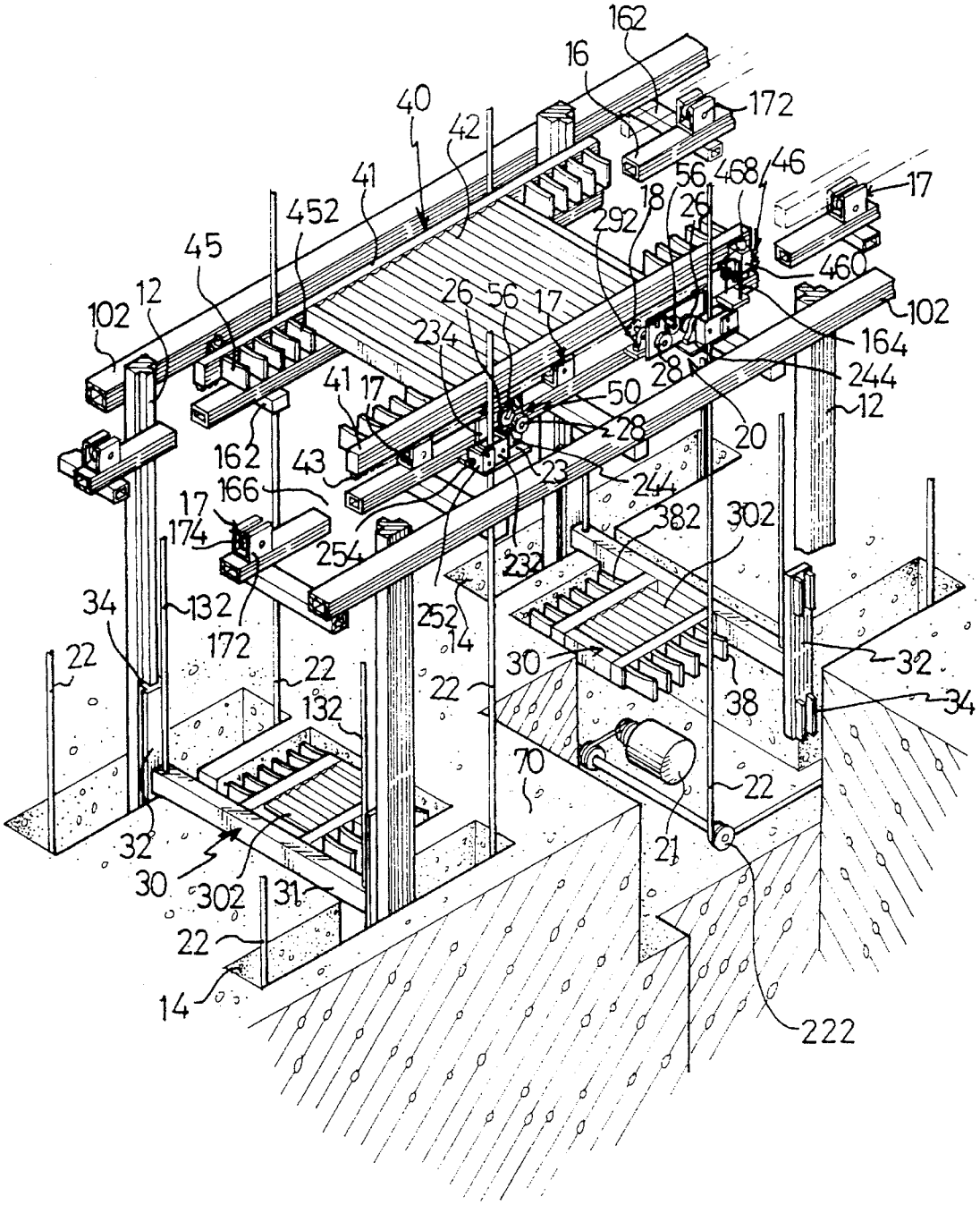
FIG. 3 is a partially perspective view of the parking tower.

Referring to FIGS. 2 and 3, there are two pits 14 defined in the ground 70 beside the elevating zone 11, two pairs of substantially T-shaped posts 12 securely mounted in the frame structure 10 and each pair mounted in a corresponding one of the pits 14, each of the pair of posts 12 having a lower end received in one side of associated pit 14, four struts 32 each movably mounted on a corresponding one of the T-shaped posts 12, each of the struts 32 including a U-shaped track 34 mounted around associated T-shaped post 12 for guiding movement of the strut 32. The elevator 30 comprises a pair of elevating bases 302 for supporting car 60, each initially received in a corresponding one of the pits 14 and each having a linking rod 31 securely connecting between associated two struts 32, each of the linking rods 31 having two distal ends each driven by one free end of associated elevating belt 132 such that the elevating bases 302 are able to move up and down freely, each of the elevating bases 302 has a plurality of supporting blades 38 protruding from two free ends thereof and in alignment with each other, each of the plurality of supporting blades 38 having an arcuate configuration 382 formed on a top surface thereof.

A plurality of supporting struts 162 are securely mounted on each of the beams 102 and protrude inwardly therefrom, a pair of elongated parallel supporting beams 16 each fixedly mounted on associated plurality of supporting struts 162. Preferably, each of the supporting beams 16 defines two gaps 166 each located between the parking zone 15 and the elevating zone 11, thereby allowing associated linking rod 31 of the elevator 30 to pass therethrough. A plurality of U-shaped brackets 172 are securely mounted on each of the pair of supporting beams 16, a plurality of sheaves 17 are each rotatably mounted in a corresponding one of the U-shaped brackets 172, and a groove 174 is defined in each of the sheaves 17. A plurality of primary pinions 18 are rotatably mounted on each of the pair of supporting beams 16. Preferably, a plurality of secondary pinions 182 each are rotatably mounted between associated primary pinion 18 and associated sheave 17.

Figure 6:
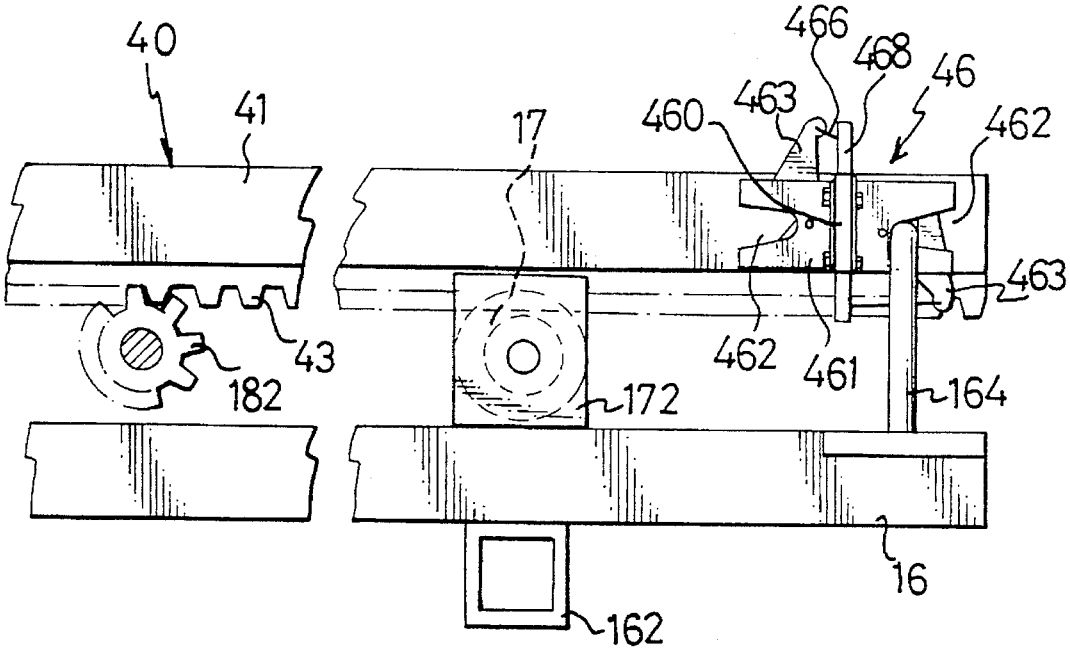
FIG. 6 is a front plan partially cross-sectional view showing a snapping member co-operating with a positioning member.

Again referring to FIGS. 2 and 3 with reference to FIG. 6, each of the conveying devices 40 comprises a pair elongated parallel conveying beams 41 each movable on a corresponding one of the supporting beams 16, a conveying base 42 connected between the pair of conveying beams 41, a plurality of supporting blades 45 formed on each of the pair of conveying beams 41 beside the conveying base 42 and aligned with each other, and each of the supporting blades 45 having an arcuate configuration 452 formed on a top surface thereof. An elongated rack 43 is formed on an underside of each of the conveying beams 41 to mesh with associated primary and secondary pinions 18 and 182, thereby moving the conveying device 40 horizontally. It is appreciated that each of the racks 43 is slidably received in the groove 174 of associated sheave 17 in the corresponding U-shaped bracket 172 for guiding and stabilizing the conveying device 40. Preferably, a pair of flange portions (not labeled) each are respectively formed on top of a corresponding one of the two sides of the U-shaped bracket 172 and extend inwardly with each other for retaining associated rack 43 on the conveying beam 41 of the conveying device 40 (best shown in FIGS. 3 and 6).

Figure 4:
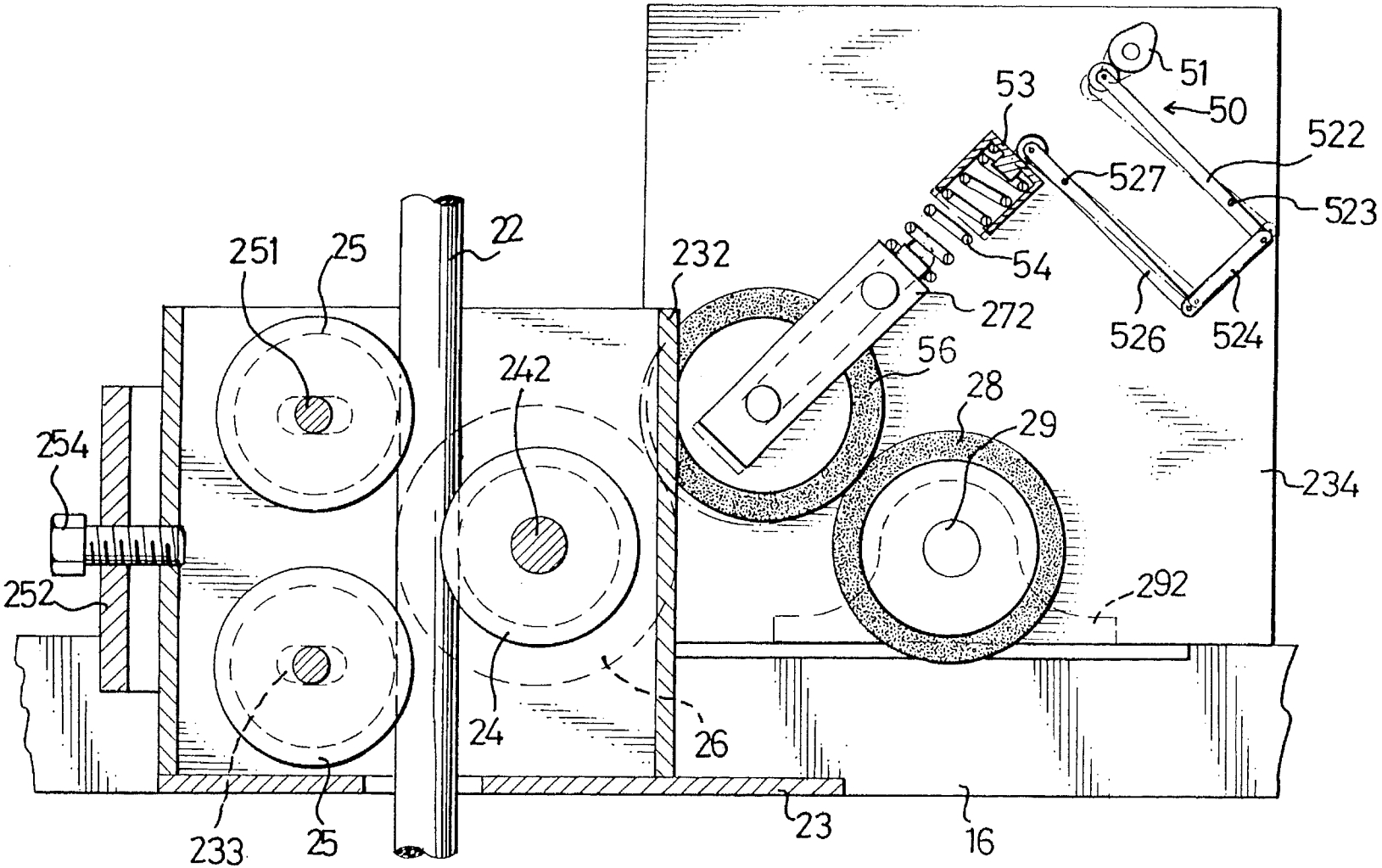
FIG. 4 is a front plan cross-sectional view of a transmission device co-operating with a manipulating device.
Figure 5:
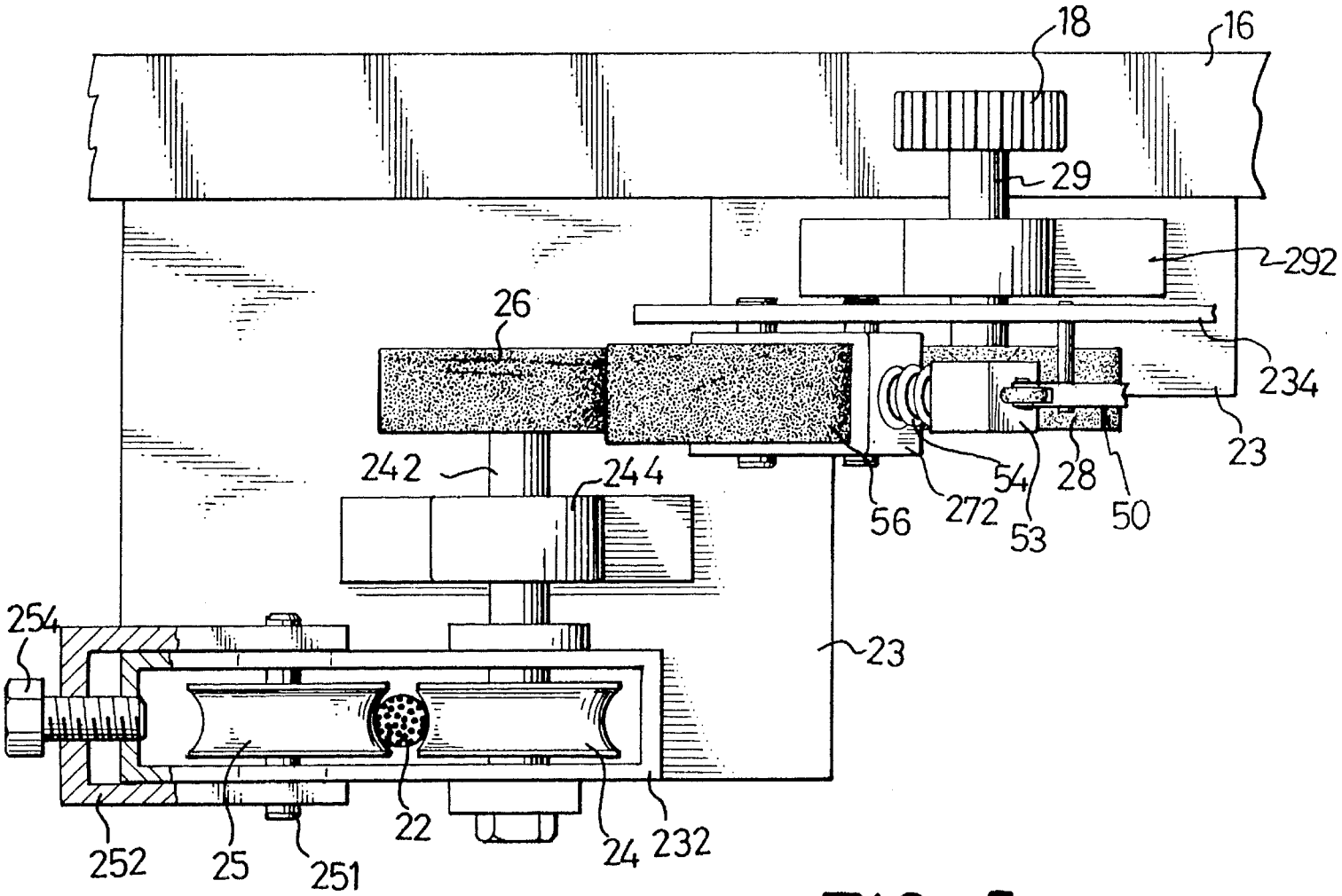
FIG. 5 is a top plan cross-sectional view as shown in FIG. 4.

Referring to FIGS. 4 and 5 with reference to FIGS. 2 and 3, a plurality of base plates 23 are horizontally attached to each of the supporting beams 16 and protrude outwardly therefrom, a side plate 234 vertically mounted on each of the base plates 23, and a supporting housing 232 vertically mounted on each of the base plates 23. Preferably, each of the supporting beams 16 has two pairs of supporting housings 232 each pair mounted near a corresponding one of the two gaps 166 of associated supporting beams 16. One of the pair of supporting housings 232 is located on the elevating zone 11 and the other is located on the parking zone 15. A driving device comprises a pair of motors 21 each mounted in a corresponding one of the two pits 14 under the ground 70, each of the motors 21 capable of actuating two roller means 222 respectively via a rotary rod (not labeled), each of the roller means 222 mounted on one side of associated pit 14 to respectively drive a transmission wire 22 which forms a loop so as to displace vertically and reciprocally to pass through a corresponding pair of supporting housing 232 on the base plates 23 of a corresponding one of the supporting beams 16.

A plurality of transmission devices 20 each comprise a first pivot base 244 and a second pivot base 292 securely mounted on each of the base plates 23, a first pivot axle 242 and a second pivot axle 29 each respectively and rotatably mounted on the first and second pivot bases 244 and 292, a drive wheel 24 rotatably mounted in each of the supporting housings 232 for biasing against one side of associated transmission wire 22 and fixedly mounted around a first distal end of the first pivot axle 242, a pair of urging wheels 25 also rotatably mounted in the corresponding supporting housing 232 and respectively abutting against the other side of the transmission wire 22 such that the drive wheel 24 is actuated to rotate by movement of the transmission wire 22, a transmission wheel 26 fixedly mounted on a second distal end of the first pivot axle 242 to be rotated in concert with the drive wheel 24, and a driven wheel 28 and one of the primary pinions 18 being respectively and fixedly mounted around first and second distal ends of the second pivot axle 29 to be rotated in concert with each other.

There are a plurality of manipulating devices 50 each respectively mounted on a corresponding one of the side plates 234 and comprising a connecting wheel 56 detachably engaged between a corresponding transmission wheel 26 and associated driven wheel 28. When the connecting wheel 56 is displaced to be in contact with associated transmission wheel 26 and driven wheel 28, the corresponding pinion 18 is operated to rotate in concert with associated drive wheel 24 by means of movement of the transmission wire 22 via the transmission and driven wheels 26 and 28, thereby forcing a corresponding rack 43 to move therewith so as to displace associated conveying device 40 horizontally between the parking zone 15 and the elevating zone 11. When the connecting wheel 56 is released from associated transmission wheel 26 and driven wheel 28, the drive wheel will perform an idle rotation and the associated primary pinion 18 stops rotating.

The manipulating device 50 comprises a movable bracket 272 slidably mounted on the side plate 234, the connecting wheel 56 rotatably mounted in the movable bracket 272, a buffering member 54 having a first distal end securely attached to the movable bracket 272 and a second distal end securely received in a movable chamber 53, a first lever 526 pivotally mounted on a first axle 527 and having a first free end pivotally attached to the movable chamber 53 and a second free end, a linking rod 524 having a first end pivotally engaged with the second free end of the first lever 526 and a second end, a second lever 522 pivotally mounted on a second axle 523 and having a first free end pivotally engaged with the second end of the linking rod 524 and a second free end pivotally attached to a cam means 51. It is appreciated that the first and second axles 527 and 523 are respectively positioned closer the first free end of first and second levers 526 and 522. By such an arrangement, the cam means 51 is able to easily actuate the connecting wheel 56 to be in contact with or released from the transmission wheel 56 and the driven wheel 28 by exerting a little force on the second free end of the second lever 522. Preferably, an urging bracket 252 is movably mounted around each of the supporting housings 232, each of the urging wheels 25 fixedly mounted around an axle 251 which has two free ends each extending through an elongated slot 233 defined in the supporting housing 232 and each rotatably mounted in the urging bracket 252 to move therewith, and a bolt 254 threadedly extending through the urging bracket 252 and supporting housing 232. The bolt 254 is rotated to abut against the urging bracket 252 which is able to force the axle 251 together with the urging wheel 25 to move toward the transmission wire 22 along the elongated slot 234, thereby urging the transmission wire 22 between the drive wheel 24 and the urging wheels 25.

Figure 7:
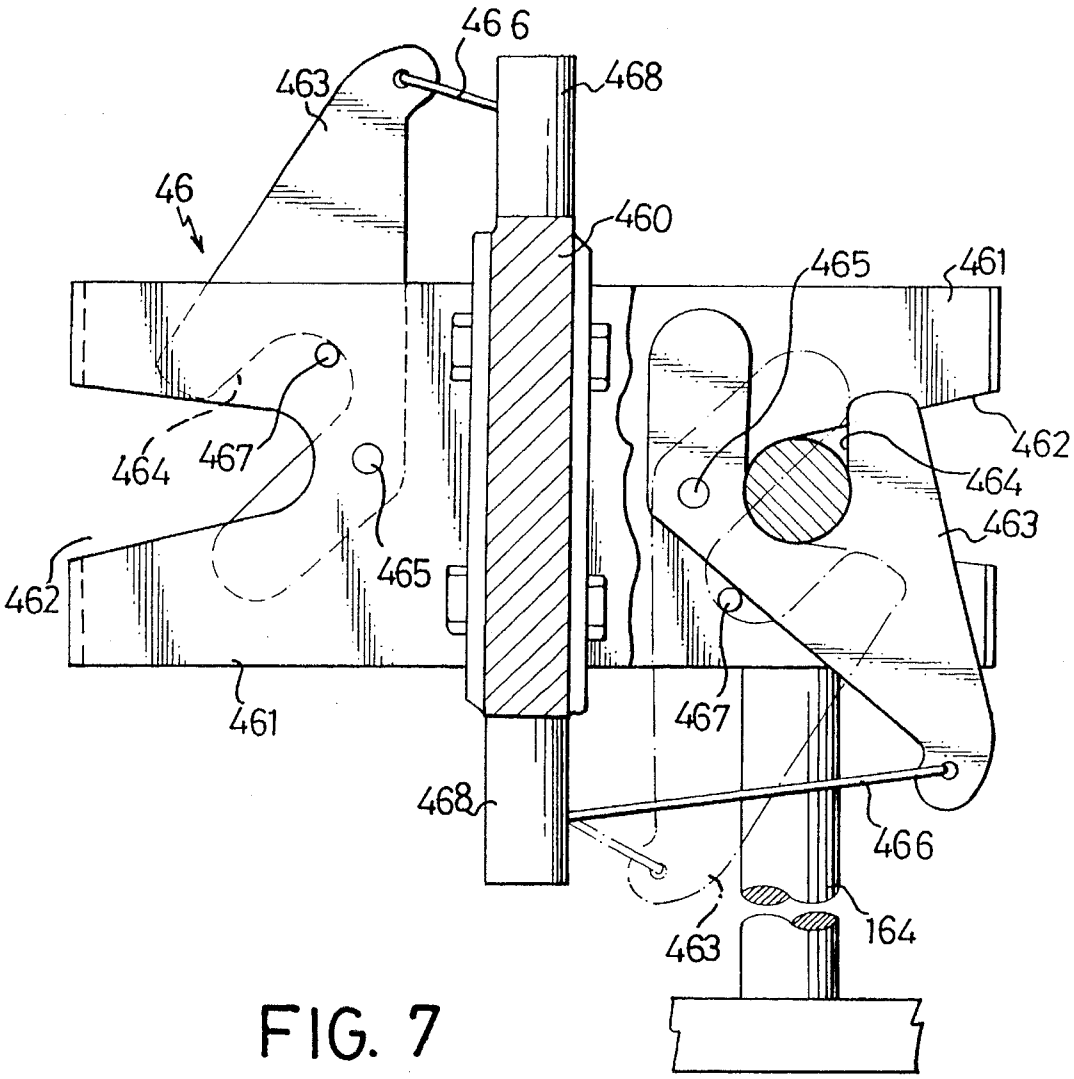
FIG. 7 is an enlarged cross-sectional view of FIG. 6.

Referring to FIGS. 6 and 7 with reference to FIGS. 2 and 3, a plurality of substantially U-shaped positioning members 164 are respectively and fixedly mounted on each of the supporting beams 16 and laterally protrude outward therefrom, each of the conveying devices 40 comprising a snapping member 46 laterally mounted on one of the conveying beams 41 thereof for detachably engaging with a corresponding one of the positioning members 164. Each of the snapping members 46 comprises a block 460 projecting from the conveying beam 41, a control means 468 mounted on the block 460, a pair of casings 461 each laterally formed on one side of the block 460 and each laterally defining a notch 462 therein, said notches facing toward an opposite direction with each other, a pair of locking elements 463 each pivotally mounted in a corresponding one of the casings 461 by means of a pin 465 and each having a free end connected to a linking wire 466 which is retractably mounted in the control means 468, a substantially U-shaped recess 464 laterally defined in each of the locking elements 463 and facing in the same direction as the notch 462 of associated casing 461, a pair of urging members 467 each detachably biased against the recess 464 of a corresponding locking element 463. In operation, the locking element 463 is initially positioned in a status as shown in FIG. 7 in phantom lines. When the conveying device 40 is moved to transport one of the casings 461 together with associated locking element 463 to abut against the U-shaped positioning member 164, the locking element 463 is able to pivot about the pin 465 to a position as shown in solid lines where the positioning member 164 is locked in the recess 464 of the locking element 463 with the urging member 467 urged against one side of the locking element 463, thereby positioning the conveying device 40. The control means 468 is operated to force the urging member 467 to be detached from the locking element 463, thereby retracting the locking element 463 backward by means of the retractable linking wire 466 so as to release the positioning member 164 from the recess 464.

In operation, referring to FIGS. 1–3, when desiring to parking the car 60, the elevator 30 is initially disposed in the pits 14 with a top surface in alignment with the ground 70 and the car 60 is stopped on the elevator 30 in the elevating zone 11 with the wheels (not labeled) thereof disposed on the elevating bases 302, the elevator 30 is then elevated to a position higher than the layer to be parked therein. Then, by means of releasing the snapping member 46 from the positioning member 17, one of the conveying devices 40, e.g., the right conveying device, is actuated to displace from the parking zone 15 to the elevating zone 11 by associated primary pinions 18 mounted on the parking zone 15 via the transmission wires 22 co-operating with the transmission device 20 and associated manipulating device 50 and is moved to a position under the elevator 30 with the supporting blades 45 of the conveying device 40 in alternate alignment with the supporting blades 38 of the elevating bases 302. The elevator 30 is then lowered down to pass through the conveying device 40 in a comb-like manner, thereby disposing the wheels of the car 60 on the supporting blades 45, the conveying device 40 is subsequently driven by the primary pinions 18 mounted on the elevating zone 11 via the transmission wires 22 co-operating with the transmission device 20 and associated manipulating device 50 to displace from the elevating zone 11 to the parking zone 15, thereby accomplishing the parking operation.

On the contrary, when a user desires to get his car 60, again by means of releasing the snapping member 46 from the positioning member 17, the conveying device 40 is actuated to be displaced by associated primary pinions 18 mounted on the parking zone 15 via the transmission wires 22 co-operating with the transmission device 20 and associated manipulating device 50 and is moved from the parking zone 15 to the elevating zone 11 of associated layer with the supporting blades 45 of the conveying device 40 in alternate alignment with the supporting blades 38 of the elevating bases 302. The elevator 30 on the ground 70 is then elevated to pass through the conveying device 40 in a comb-like manner, thereby disposing the wheels of the car 60 on the supporting blades 38 of the elevating bases 302, the conveying device 40 is again driven by the primary pinions 18 mounted on the elevating zone 11 via the transmission wires 22 co-operating with the transmission device 20 and associated manipulating device 50 in a converse manner to displace from the elevating zone 11 to the parking zone 15, the elevator 30 is subsequently lowered to the ground 70, thereby accomplishing a procedure of taking the car 60.

It is to be noted that, when the primary pinions 18 on the elevating zone 11 are not in contact with the racks 43 of the conveying device 40, the corresponding manipulating device 50 mounted on the elevating zone 11 is not actuated to move the connecting wheel 56 to abut between associated transmission and driven wheels 26 and 28, i.e., the primary pinions 18 on the elevating zone 11 idle while the primary pinions 18 mounted on the parking zone 15 are rotated via the manipulating device 50 mounted on the parking zone 15 co-operating with associated transmission device 20 so as to move the conveying device 40 from the parking zone 15 toward the elevating zone 11. When the primary pinions 18 on the elevating zone 11 mesh with the racks 43 of the moving conveying device 40, the manipulating device 50 mounted on the elevating zone 11 is actuated to co-operate with associated transmission device 20, thereby rotating the primary pinions 18 mounted on the elevating zone 11 so as to proceed to displace the conveying device 40 to the elevating zone 11.

Figure 8:
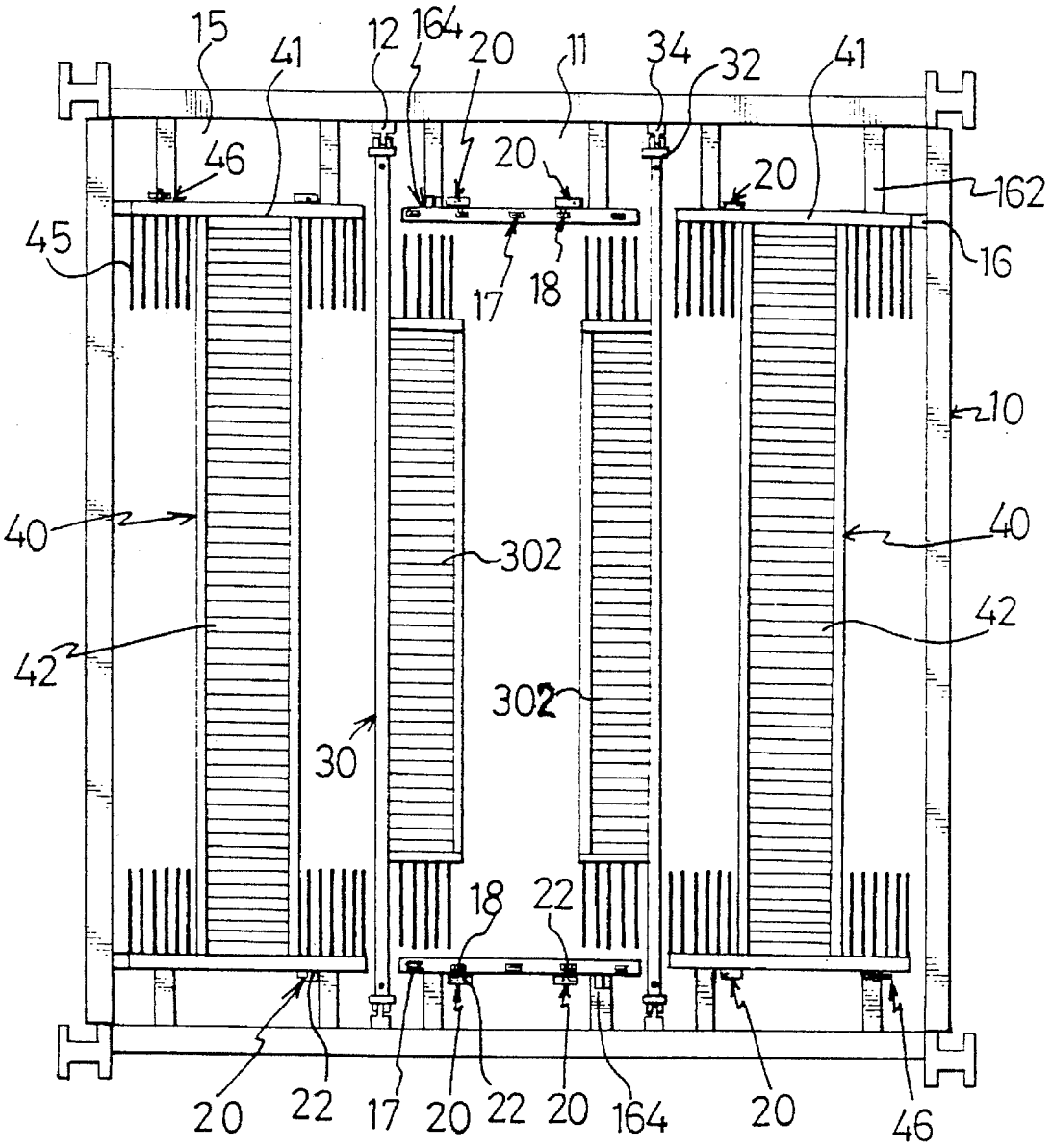
FIG. 8 is a top plan view of a parking tower in accordance with a second embodiment of the present invention.

By the above-mentioned operation, each of the conveying devices 40 is moved in a direction parallel to a longitudinal direction of the car 60. Now, referring to FIG. 8, in accordance with a second embodiment of the present invention, each of the conveying devices 40 is moved in a direction perpendicular to a longitudinal direction of the car 60.

Accordingly, a parking tower in accordance with the present invention has the following advantages and benefits:

(1) The horizontal movement of the conveying device between the parking zone and the elevating zone is controlled primarily by a few driving motors to actuate the transmission wire which co-operates with a plurality of rotating wheels without the need for installing a large number of actuating motors as required in the conventional parking tower, thereby greatly decreasing costs in installation and reducing the complexity in operational procedures.

(2) The plurality of rotating wheels are made of engineering plastic which has a rigid structure with great endurance, so little noise is created in the operational process of the power tower, thereby causing a comfortable sense to the user.

It should be clear to those skilled in the art that further embodiments of the present invention may be made without departing from the teachings of the present invention.

What is claimed is:

1. A parking tower comprising:

a frame structure mounted on the ground and comprising a plurality of layers each having at least one parking zone provided therein for parking a car;

a lifting device mounted on top of said frame structure;

an elevator device mounted in said frame structure and movable up and down to each of said plurality of layers by means of said lifting device;

at least one conveying device slidably mounted on each of said plurality of layers and movable horizontally in said parking zone of associated said layer for supporting said car thereon which is transported to associated said layer by means of said elevator device, a pair of parallel racks longitudinally formed on an underside of said conveying device;

at least one pair of pinions mounted in each of said plurality of layers and each meshing with a corresponding one of said pair of parallel racks;

at least one driving device mounted in said frame structure and comprising a motor mounted under the ground, a pair of transmission wires each driven by means of said motor to move vertically and reciprocally to each of said plurality of layers;

at least one pair of transmission devices mounted on each of said plurality of layers and each actuated by means of a corresponding one of said pair of transmission wires of said driving device for rotating a corresponding one of said pair of pinions, each of said pair of transmission devices comprising a first pivot base and a second pivot base fixedly mounted on each of said plurality of layers, a first pivot axle and a second pivot axle each respectively and rotatably mounted on said first and second pivot bases and each having first and second distal ends, a drive wheel fixedly mounted on the first distal end of said first pivot axle and biasing against one side of a corresponding one of said pair of transmission wires, a pair of urging wheels each respectively abutting against the other side of associated said transmission wire such that said drive wheel is actuated to rotate by movement of associated said transmission wire, a transmission wheel fixedly mounted on the second distal end of said first pivot axle to be rotated in concert with said drive wheel, a driven wheel and a corresponding one of said pair of pinions respectively and fixedly mounted on first and second distal ends of said second pivot axle and rotated in concert with each other;

at least one pair of manipulating devices each detachably connecting between a corresponding one of said pair of transmission devices and associated said pinion, each of said pair of manipulating devices comprising a connecting wheel detachably engaged between said transmission wheel of associated said transmission device and associated said driven wheel, said connecting wheel being movable between a first position where said connecting wheel is in contact with said transmission wheel of associated said transmission device and associated said driven wheel such that each of said pair of pinions is operated to rotate in concert with said transmission wheel of associated said transmission device via associated said driven wheel by means of said driving device, thereby moving associated said rack therewith so as to displace said conveying device horizontally, and a second position where said connecting wheel is disengaged with said transmission wheel of associated said transmission device and associated said driven wheel such that each of said pair of pinions stops rotating.

2. The parking tower in accordance with claim 1, wherein each of said pair of manipulating devices comprises a movable bracket movably mounted on each of said plurality of layers, said connecting wheel being rotatably mounted on said movable bracket to move therewith, a buffering member having a first distal end securely attached to said movable bracket and a second distal end securely received in a movable chamber, a first lever having a mediate portion pivotally mounted on a first axle and having a first free end pivotally attached to said movable chamber and a second free end, a linking rod having a first end pivotally engaged with the second free end of said first lever and a second end, a second lever having a mediate portion pivotally mounted on a second axle and having a first free end pivotally engaged with the second end of said linking rod and a second free end pivotally attached to a cam means.

3. The parking tower in accordance with claim 1, further comprising at least one pair of U-shaped brackets securely mounted on each of said plurality of layers, a pair of sheaves each rotatably mounted in a corresponding one of said U-shaped brackets and each mounted on an underside of a corresponding one of said pair of racks of said conveying device, a groove defined in each of said pair of sheaves for receiving and guiding associated said rack therein.

* * * * *